US005115382A

United States Patent [19]

Smith

[11] Patent Number: 5,115,382

[45] Date of Patent: May 19, 1992

[54] HEADLAMP APPARATUS

[76] Inventor: Robert C. Smith, 4440 Bacall Ct., Sacramento, Calif. 95842

[21] Appl. No.: 590,133

[22] Filed: Sep. 28, 1990

[51] Int. Cl.[5] ..... F21L 15/14

[52] U.S. Cl. ..... 362/105; 362/397; 362/183; 362/191; 2/209.2

[58] Field of Search ..... 362/103, 105, 191, 804, 362/183, 397; 2/171, 185 R, 209.2, 199, D11

[56] References Cited

U.S. PATENT DOCUMENTS

| | | | |
|---|---|---|---|
| 1,925,593 | 9/1933 | Long | 362/105 |
| 3,828,201 | 8/1974 | Allen, Sr. | 307/150 |
| 4,429,351 | 11/1984 | Petzl et al. | 362/105 |
| 4,631,644 | 12/1986 | Dannhauer | 362/105 |
| 4,631,645 | 12/1986 | Lenart | 362/105 |
| 4,794,496 | 12/1988 | Lanes et al. | 362/105 |
| 4,916,594 | 4/1990 | Headley | 362/183 |

FOREIGN PATENT DOCUMENTS

| | | | |
|---|---|---|---|
| 1422308 | 11/1965 | France | 362/103 |

*Primary Examiner*—Ira S. Lazarus
*Assistant Examiner*—D. M. Cox

[57] ABSTRACT

A headlamp apparatus including an adjustable headband, a lamp assembly, and rechargeable batteries in a remote belt attachable battery housing. The headband includes adjustable circumferal and longitudinal band members, with both band members structured for a wide range of independent size adjustments through the use of hook and loop type fasteners. The lamp assembly is comprised of a telescoping tubular housing containing a focusable lamp, reflector, and lens arrangement. The lamp assembly is adjustably affixed to the headband with a double ball and socket universal fitting which allows a wide range of adjustment of the direction of the emitted light. Electrical conductors connecting the lamp assembly to the battery housing are located over the top of the user's head and down the back, positioned out of the user's work area. The battery housing is sized for placement into a clothing pocket or can be releasably affixed to the belt of the wearer with an attachment clip. The battery housing includes an electrical jack to receive a cord attached plug connected to a step-down transformer to allow supplementing and charging the batteries. Various attachable colored lenses are provided for altering the color of the emitted light.

4 Claims, 8 Drawing Sheets

HEADLAMP APPARATUS

BACKGROUND OF THE INVENTION

1. Field of the Invention:

This invention relates to lighting assemblies affixed to headbands and worn on a person's forehead for illuminating work areas.

2. Description of the Prior Art

There often exists the need in many situations for an additional or supplemental light source, such as while performing medical procedures, auto repair, and interior building repairs for example. Traditionally these additional light sources have been provided in many forms including lights affixed to portable floor stands, handheld "drop" lights powered by extension cords, and conventional battery powered flashlights to name a few. The use of hand-held drop lights with extension cords have numerous possible disadvantages depending on the work situation. Some of these possible disadvantages include the inconvenience of manipulating the long and somewhat inflexible heavy cord, cords which are not always long enough to reach outlets, work areas where electric outlets are not available at all, and attempting to find a suitable place to attach or lay the light so it will illuminate directly onto the work area, not to mention the possible hazard of a person tripping over the cord. Most of the possible disadvantages associated with drop lights may also be applicable to lights attached to portable floor stands.

Flashlights, although sometimes more convenient than drop lights and floor stand lights, also have a disadvantage in that the user must hold the light or find a suitable support where the light will correctly illuminate the work area. Another possible disadvantage of an exclusively battery powered light such as a flashlight, is that the power in the batteries may be used up part way through a task, leaving the user without a light prior to completing his work. Batteries are also somewhat expensive to buy only to be used up and thrown away when expended.

In an attempt to solve some of the above stated problems, battery powered lamps have in the past been provided which are mountable to a person's head. These head attachable lamps are convenient in that the light may be positioned to light the area that the user wishes to see, usually straight in front of his eyes. Head attachable lamps are also convenient in that they leave both of the user's hands free with which to work. Some of these earlier head lamps were attached to headbands which had relatively heavy battery packs affixed thereto, which proved to be uncomfortable for the wearer due to the excessive weight, especially for extended usage.

Later models of head mountable lamps were structured with remote battery packs attachable elsewhere on the user, with the battery packs connected by flexible conductors to the lamp units. Although these later models constituted significant improvements over the previous structures which had the batteries attached to the headband which supported the lamp unit, they still contained various disadvantages, such as discomfort when worn due to the structures of the headband, and the inability to operate the lamps for an extended period of time.

A past art search was conducted for lights affixed to headbands and worn on a person's forehead for illuminating work areas. Of the disclosures examined, the following appeared to disclose devices most relevant to my invention:

Long was granted U.S. Pat. No. 1,925,593, on Sep. 5, 1933, for a head support for an electric light. The Long patent illustrates circumferal and longitudinal support straps comprising his headband for supporting a lamp unit. The Long over-head longitudinal strap is affixed stationary at each end thereof to the circumferal strap which is for placing around the circumference of the head. The circumferal strap is adjustable with a buckle, but the over-head band in not adjustable. The stationary affixment of the over-head strap at both ends thereof to the adjustable circumferal strap greatly limits adjustability of the headband in general because too much adjustment of the circumferal band would pull the over-head strap off center of the wearer's head, making for an uncomfortable and loose fit.

On Aug. 6, 1974, Allen was granted U.S. Pat. No. 3,828,201, for a portable power supply for a light source. Allen shows a lamp affixed to a headband, with the lamp powered by a remote power supply. The headband arrangement of Allen possesses the same basic structuring as the Long headband, and therefore the same basic problems.

Dannhauer was issued U.S. Pat. No. 4,631,644, date Dec. 23, 1986, for a portable lamp, adapted to be worn on the head of the user. Dannhauer's device shows an adjustable battery powered lamp removably affixed to an adjustable headband. The batteries for the lamp are retained in a battery housing attachable to the pocket or belt of the user.

Lanes et al was granted U.S. Pat. No. 4,794,496, on Dec. 27, 1988, for a headband lamp apparatus. The Lanes disclosure shows an adjustably positionable and focusable lamp affixed to an adjustable headband. The batteries used to power the lamp of the Lanes device are affixed directly to the headband, an arrangement where large batteries add too much weight to the headband for long term comfortable wearing of the apparatus, or smaller lightweight batteries will not power the lamp for any appreciable period of time. The Lanes lighting apparatus uses rechargeable batteries, however the battery recharging arrangement disclosed by Lanes does not allow the charging or supplementing of the batteries while the lighting apparatus is being worn and used, requiring the user of the device to have an extra set of charged batteries for using the lighting apparatus for a period of time which exceeds the time which a single set of batteries may power the lamp.

Both the Lanes et al and Dannhauer devices show one-piece headbands which are only adjustable circumferentially about the user's head. This type of headband has proven in the past to be ineffective in preventing the lamp portion and headband from sliding downward toward the user's eyes and ears, unless the headband is secured uncomfortably tight around the head. The Long and Allen devices do show headbands with longitudinal top straps, but neither of the longitudinal top straps are adjustable in length. The range difference in the size and shape of human heads varies greatly, and a single size longitudinal support strap on the headbands will not sufficiently accommodate all adult human head sizes. Since headlamps are often worn for extended periods of time, comfort and ease in use becomes a major consideration. The Dannhauer and Allen devices show lamps which are not focusable, which can be a disadvantage since the emitted light cannot be adjustably focused to illuminate objects at various distances from the wearer. The Allen and Long devices depict lamps which are not positionable or adjustable, forcing the wearer to adjust the position of his head to direct the light in the desired direction.

SUMMARY OF THE INVENTION

I have provided an improved battery powered headlamp apparatus comprised of an adjustably positionable lamp assembly affixed to a widely adjustable headband. The lamp is powered by a remote battery housing which is affixed with a belt attachment clip for connection to the belt or pocket of the wearer. The battery housing includes a power input jack to removably receive a low voltage plug and cord arrangement from a voltage step-down electrical transformer. The step-down transformer may be plugged into a standard 120 volt outlet. The transformer and low voltage cord arrangement when plugged into the battery housing is used to supplement and charge the batteries contained therein, with this supplementing and charging arrangement allowing long term extended use of the lamp if desired. By sending only low voltage, preferably around 9 volts through the removable cord to continuously trickle charge and supplement the batteries, not only may the lamp illuminate an area for an extended period of time, but the device is very safe for the user to wear when in contact with a grounded surface. My battery supplementing and charging arrangement uses known electronic circuitry, and is very similar to that used in most modern battery powered and rechargeable electric shaving razors where if the batteries run out of power half way through a shave, a charging cord may be plugged into the razor to feed power directly to the electroreceptive device, the motor in the case of shaving, and the lamp in the case of my invention to allow completion of the immediate task. With the electrical cord plugged in with the switch of the razor or my invention in the off position, the batteries are fully recharged over a period of time.

The batteries in the battery housing will operate the lamp when the low voltage power cord is not utilized, giving the user greater freedom of mobility. The battery housing is also structured to be lightweight and compact, and easily attached to the belt or other area of the wearer.

My invention includes a lamp assembly affixed to the headband in a manner to provide a wide range of positioning adjustability to enable the wearer to redirect the light at a desired point. The positionability of my lamp assembly is also a convenience in cramped situations such as under a car where space is limited, allowing the lamp assembly to be repositioned to avoid becoming an obstacle. The adjustability in positioning of the lamp assembly eliminates the need of the wearer to redirect the position of his head every time the direction of the emitted light is desired to be altered. The lamp assembly adjustability is provided with a double universal swivel connection which not only allows one-hundred eighty degree rotation of the lamp, but horizontal and vertical repositioning as well. The lamp assembly is also focusable which helps to illuminate small, relatively distant objects which would otherwise be less easily viewed with a more spread light source.

My headband consists of an adjustable circumferal band for placement around the user's head, and an adjustable longitudinal band for placement across the top of the user's head. Both bands are specifically structured for a wide range of independent size adjustments to accommodate various head sizes and shapes of users. The adjustable longitudinal band helps prevent the affixed lamp assembly from slipping downward, eliminating the need for excessive tightening of the circumferal band. My headband arrangement helps to provide an extremely comfortable fit for the wearer, generally regardless of his head size or shape.

One feature of my device includes the use of an attachable colored lens which alters the color of the light emitted from the lamp. This feature is seen to be useful to people suffering from certain types of color vision deficiencies who desire to work with multi-colored wiring, such as their own automobile electrical systems. The colored lens may help the wearer distinguish between certain colors which would otherwise appear similar.

Therefore, a major object of my invention is to provide an improved headlamp apparatus which is not only comfortable for the wearer over long periods of use, but is also adapted for accommodating a wide range of user head sizes and shapes.

A further object of my invention is to provide the above in a headlamp apparatus which is powered by batteries stored in a belt attachable battery housing.

A further object of my invention is to provide the above in a headlamp apparatus which is powered by batteries stored in a belt attachable battery housing which includes a receiver jack to except low voltage from a step-down electrical transformer to supplement and charge the rechargeable batteries.

Another object of my invention is to provide the above in a headlamp apparatus which supplies the user the option of complete freedom of mobility utilizing the battery housing to power the lamp, or greatly extended use of the lamp through the use of a battery supplementing low voltage charging arrangement.

Another object of my invention is to provide the above in a headlamp apparatus which can be used by certain groups of color blind people for more easily distinguishing between variously colored objects.

A even further object of my invention is to provide the above in a headlamp apparatus which is lightweight, compact in size, relatively inexpensive to manufacture, and easily operated.

Further objects and advantages of my invention will become apparent from the following description and the accompanying drawings.

BRIEF DESCRIPTION OF THE DRAWINGS

FIG. 3 B is a basic flow chart of the battery charging and supplementing arrangement used with the invention.

DESCRIPTION OF THE PREFERRED EMBODIMENT

Figure 1:
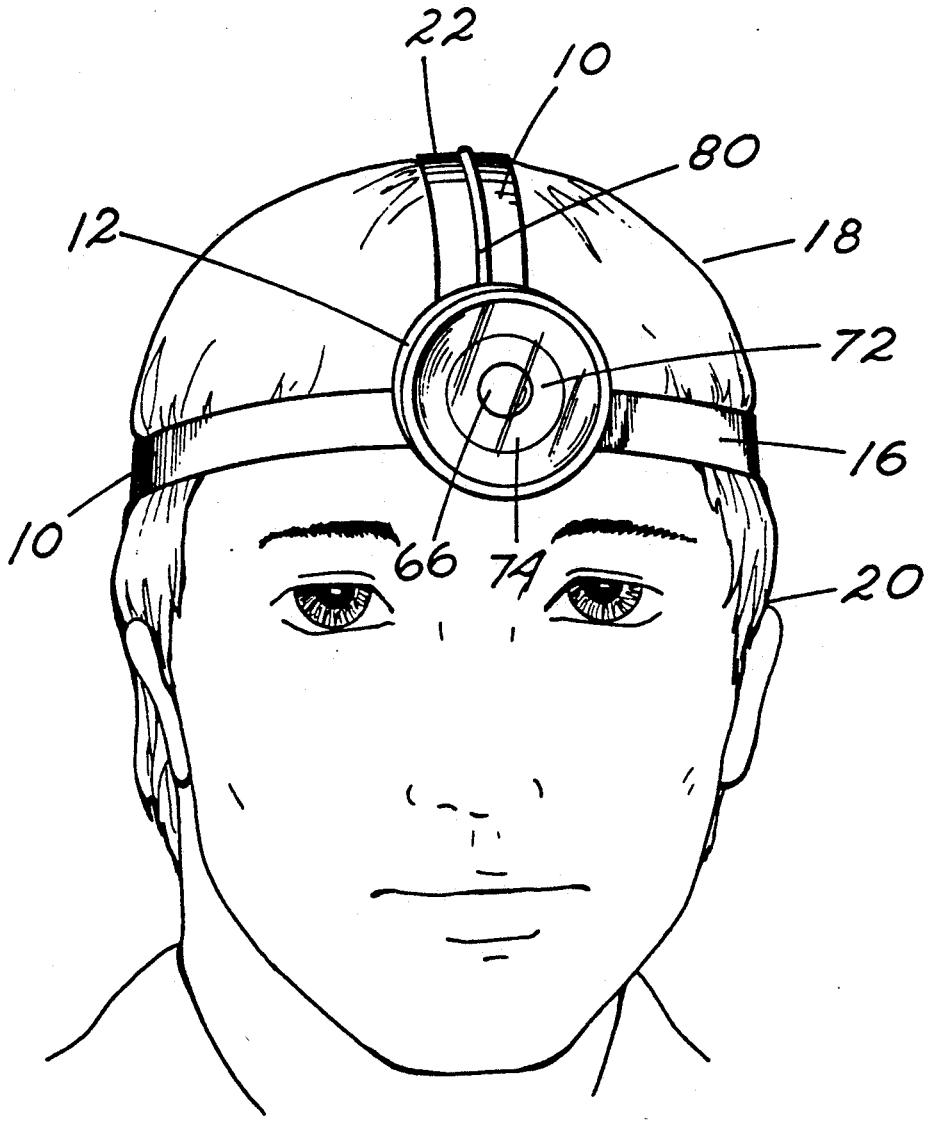
FIG. 1 shows my headlamp apparatus being worn by a person.
Figure 2:
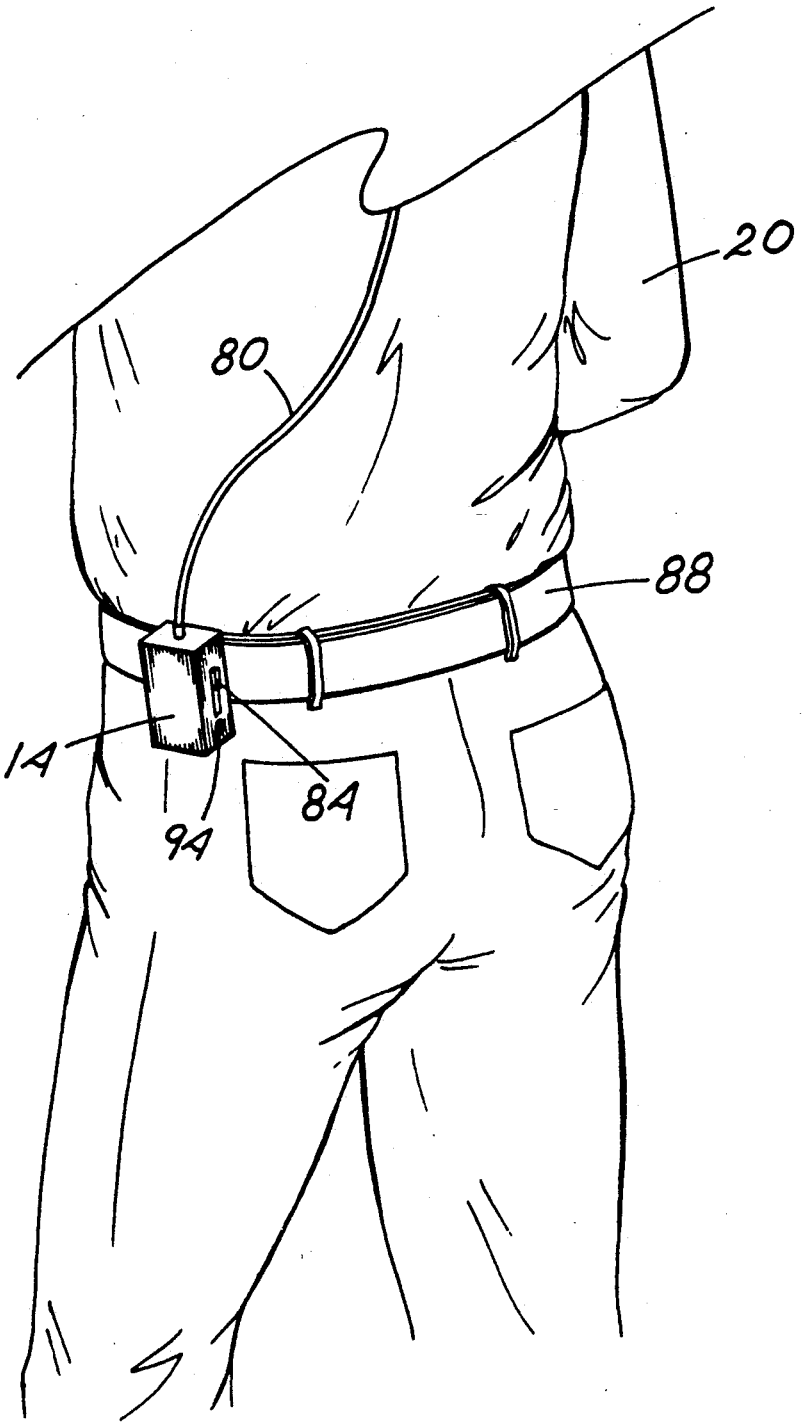
FIG. 2 illustrates the battery housing attached to the belt of the wearer.

Referring now to the drawings in general where the preferred embodiment of the invention is illustrated. Headband 10 is comprised of two band members, the first being circumferal band member 16 which is generally worn horizontally positioned around head 18 of user 20, with the second being longitudinal band member 22, which runs over the top center of head 18 from front to back of the head. Both band members 16 and 22 are preferably manufactured of a thin, flexible material such as plastic, and could conceivably be made of a stretchable resilient material. Circumferal band member 16 has an interior surface 24 and an exterior surface 26 and two oppositely disposed, free terminal ends for placement and affixment behind the head of the user. One terminal end of band member 16 is designated first terminal end 28, with the other end designated second terminal end 30. First terminal end 28 is positioned adjacent head 18 in use, with second terminal end 30 overlapping a portion of first terminal end 28. Longitudinal band member 22 also has an interior surface 24 and exterior surface 26 with one affixed end 32 and an oppositely disposed free or distal end 34. Affixed end 32 of longitudinal band member 22 is permanently affixed perpendicular to central area 36 of circumferal band member 16, with central area 36 being approximately midway between first terminal end 28 and second terminal end 30. The affixment of end 32 of longitudinal band member 22 to circumferal band member 16 is also preferably a pivotal affixment, allowing for at least a small degree pivotal movement between the two band members 16 and 22 for greater comfort in use. Longitudinal band member 22 is sufficiently sized in length for placement of distal end 34 between first terminal end 28 and second terminal end 30 of circumferal band member 16 as shown in FIG. 3 A.

First and second terminal ends 28 and 30, along with distal end 34 of headband 10, are adapted for adjustable releasable engagement with one another with the use of hook and loop fasteners 38. Exterior surface 26 of first terminal end 28 of circumferal band member 16, is affixed with a length of the hooked portion 40 of hook and loop fastener 38, while interior surface 24 of second terminal end 30 is affixed with the mating length of looped portion 42. By positioning the softer looped portion 42 adjacent head 18 of user 20, there is less chance of entanglement with the hair of user 20. Both mating sections of hook and loop fasteners 38 are sized sufficiently long for allowing a wide range of circumferal adjustment of circumferal band member 16, adapting the diameter for any size of head 18. Distal end 34 of longitudinal band member 22, is also adjustably releasably engaged to first and second terminal ends 28 and 30 of circumferential band member 16, with the same attachment structure utilizing hook and loop fasteners 38. Interior surface 24 at distal end 34 of longitudinal band member 22 is affixed with a length of looped portion 42 of hook and loop fastener 38, which can be releasably connected to hooked portion 40 affixed to the exterior of first terminal end 28. Exterior surface 26 at distal end 34 of longitudinal band member 22 is affixed with hooked portion 40 of hook and loop fasteners 38 and can be releasably affixed to looped portion 42 of second terminal end 30. The length of hook and loop fasteners 38 affixed to distal end 34 of longitudinal band member 22 allows a wide measure of length adjustment of longitudinal band member 22, thus allowing vertical repositioning of circumferal band member 16 on head 18 of user 20.

Figure 5:
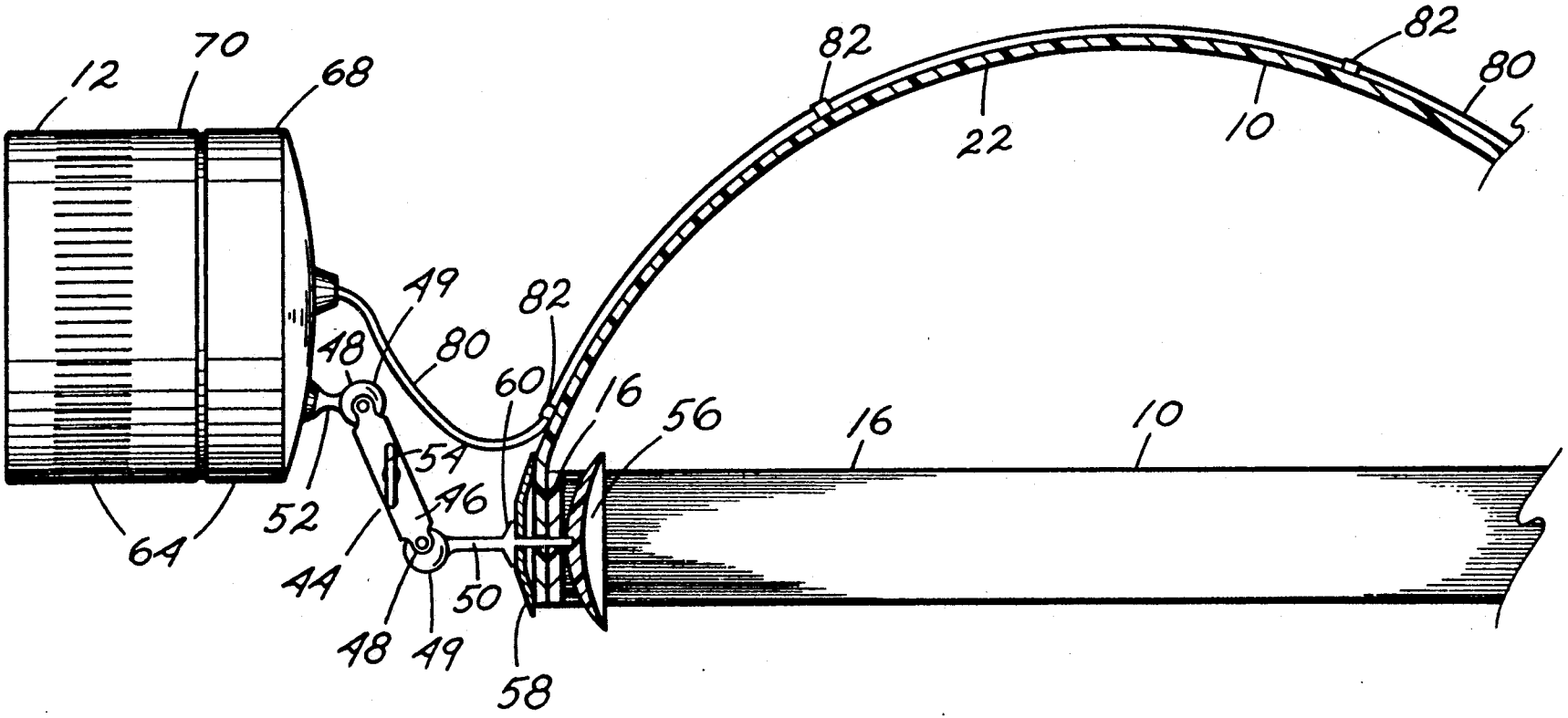
FIG. 5 is a side view of the frontal portion of the assembled headband showing various sections of the headband in cross section. Also shown is the double universal connective linkage between the lamp assembly and the headband.
Figure 6:
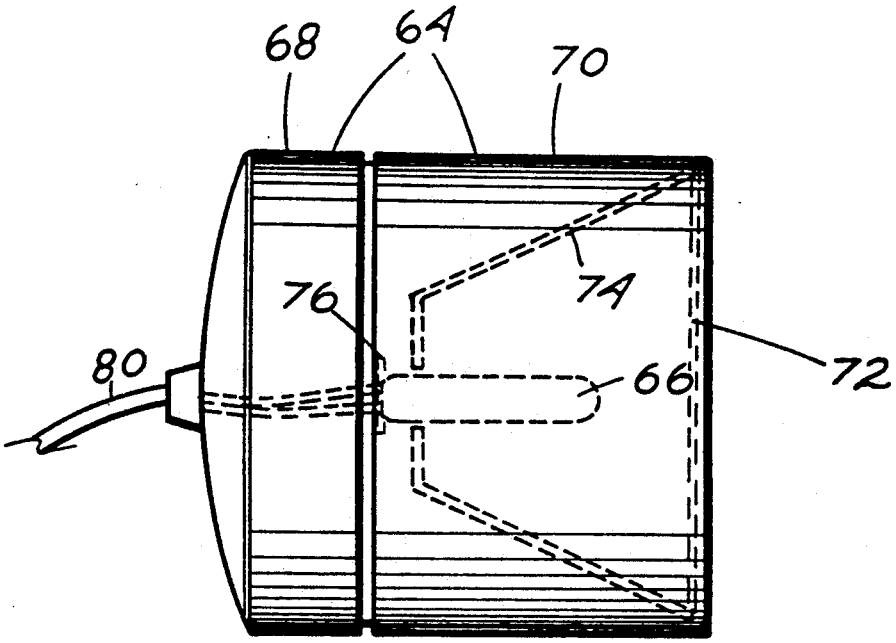
FIG. 6 is an enlarged side view of the lamp housing depicting the internal lamp or bulb and reflector in dotted outline.
Figure 7:
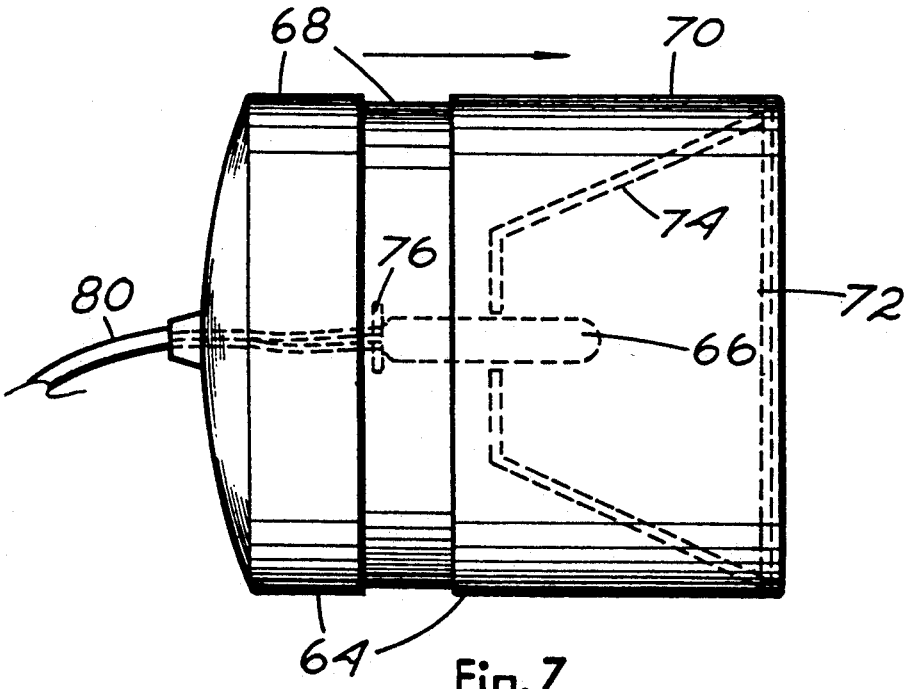
FIG. 7 is an enlarged side view of the lamp assembly illustrating the focusing whereby the light beam is condensed for illuminating objects farther away, or spread for illuminating a wider area.
Figure 8:
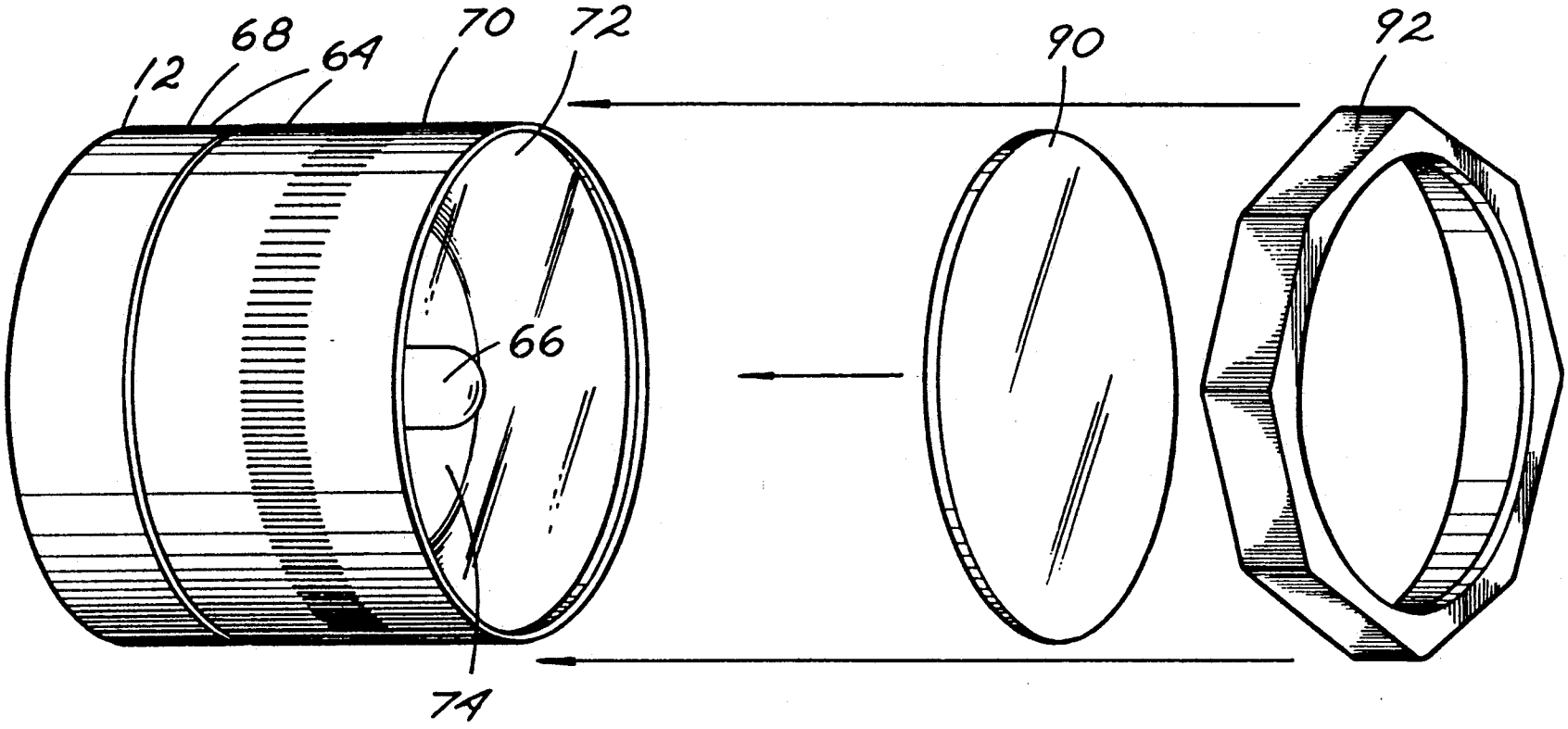
FIG. 8 is a perspective enlarged side view of the lamp assembly illustrating the colored lens and lens retainer ring.

At the junction of the attachment of affixed end 32 of longitudinal band member 22 to central area 36 of circumferal band member 16 is the attachment of a double universal linkage 44. Universal linkage 44 is a movable, element consisting of a short two-piece body member 46 endwardly affixed with two ball and socket joints 48, with each ball 49 affixed with a short attachment pin. The two attachment pins are designated first attachment pin 50 and second attachment pin 52. The center section of body member 46 is affixed with a thumb screw 54 which is used to regulate the pressure exerted against both balls 49 by both opposing body members 46. First attachment pin 50 is affixed to headband 10, and extends through affixed end 32 of longitudinal band member 22, and central area 36 of circumferal band member 16. The distal end of first attachment pin 50 projects beyond interior surface 24 of circumferal band member 16 and is affixed to suction cup 56. Suction cup 56 is a small annular flexible plastic disc structured to gently adhere to the forehead of user 20 in use, helping to comfortably maintain the desired position of headband 10 and lamp assembly 12. Suction cup 56 under some conditions may be pressed against the forehead and serve as a retaining suction cup, while under other conditions, such as after the suction has been lost for whatever reason, cup 56 is manufactured out of a material which resists sliding against the skin of the forehead of the user also helping to stabilize the lamp on the head. To help provide a more secure attachment of first attachment pin 50 to headband 10, a small dish-shaped washer 58 is positioned on exterior surface 26 of longitudinal band member 22. Washer 58 abuts a small flange 60, on first attachment pin 50, which helps to provide an abutment surface for better securement of the component structures, as shown in FIG. 5. Attachment of suction cup 56 onto the distal end of first attachment pin 50 can be accomplished with a variety of methods including press fitting, adhesives, threaded bolts, or even sonic bonding if first attachment pin 50, along with the rest of universal linkage 44, were manufactured of plastic. However, it is suggested universal linkage 44 be structured of metal to extend the durability of the device. Second attachment pin 52 is somewhat shorter and wider than first attachment pin 50 and is structured for attachment to lamp assembly 12. Attachment can be adhesive, threaded bolt-on attachment or sonic bonding, similar to first attachment pin 50.

Lamp assembly 12 is basically comprised of lamp housing 64 with direct current lamp 66. Lamp housing 64 is a two piece telescoping cylindrical, plastic or metal, tube having a first housing member 68 and a second housing member 70. First housing member 68 has two opposite ends, one an exterior closed end affixed to universal linkage 44. The second open end of first housing member 68 is smaller in diameter and sized to rotatably insert into the interior of second housing member 70. Telescopic connection of first housing member 68 and second housing member 70 can be accomplished with threads, ramps or pressure and friction fitting. Second housing member 70 has an open end into which first housing member 68 is inserted, and an opposite end which is enclosed with transparent lens 72, which can be glass or plastic. The interior of lamp housing 64 is affixed with a metal or plastic cone shaped reflector 74. To adjust the focus of the light emitted from lamp 66 onto different objects at varying distances, second housing member 70 is repositioned to increase or decrease the distance between lamp 66 and lens 72, and will be further explained later.

Figure 4:
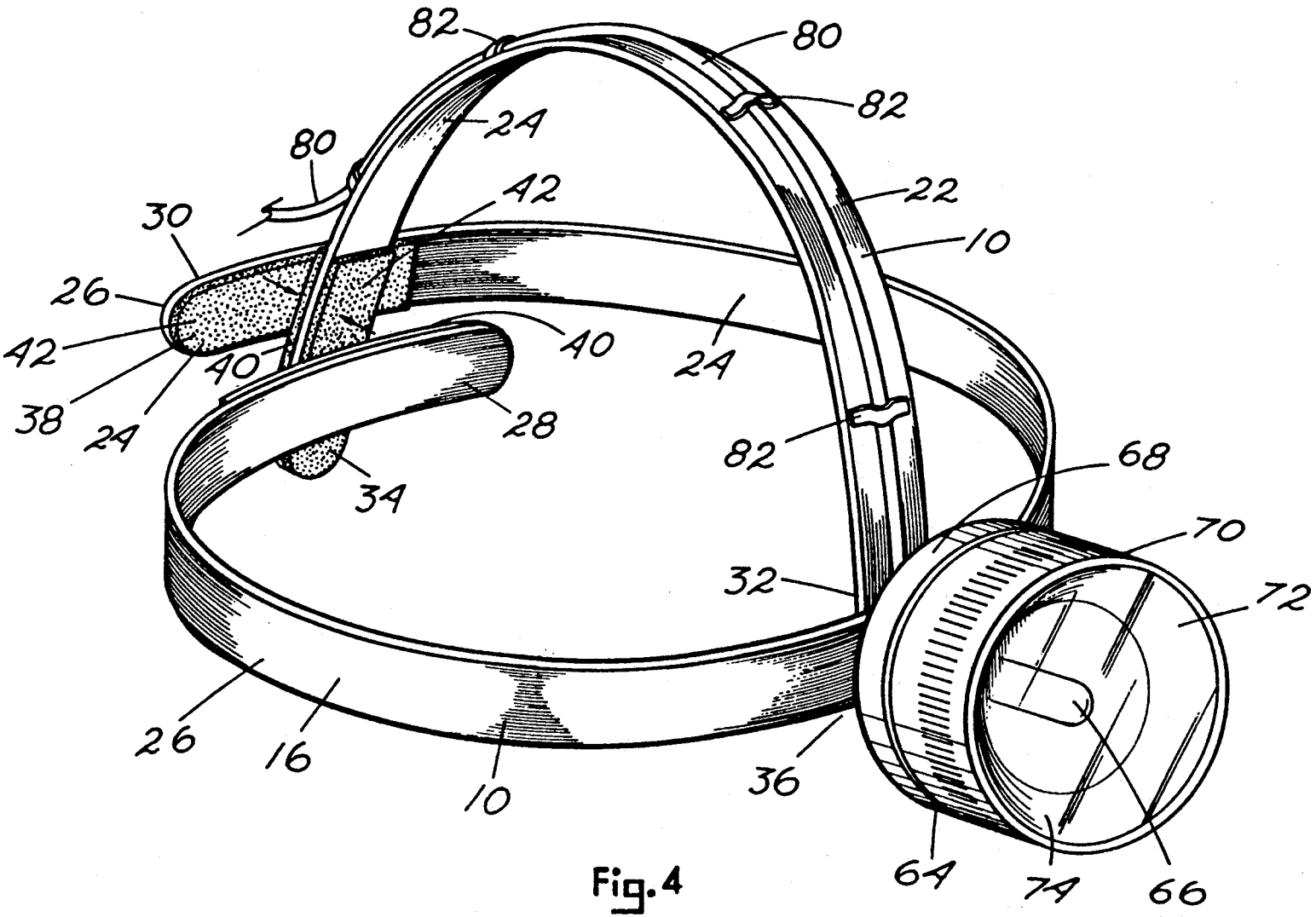
FIG. 4 is an enlarged perspective view of the headband and lamp portion of the invention.

Reflector 74 is affixed with lamp socket 76 to which is removably mounted lamp 66, with lamp 66 preferably being an incandescent halogen type bulb. Reflector 74 is designed to direct the light emitted from lamp 66, due to its conical shape and the shiny metallic finish. Lamp socket 76 is connected to a two wire insulated electrical conductor 80 which exit the closed end of first housing end 68 prior to passing over exterior surface 26 of longitudinal band member 22, and extending unattached for a specified length, to battery housing 14. Conductor 80 is affixed to exterior surface 26 of longitudinal band member 22 with several small brackets 82. As shown in FIG. 4, brackets 82 secure conductor 80 in a manner which allows the affixing together of the terminal ends of band member 16 and 22 with conductor 80 positioned to the outside of the bands and hook and loop fasteners 38.

Battery housing 14 is a small, rectangular housing preferably made of a lightweight plastic or metal structured for removably retaining at least one rechargeable battery 15. Rechargeable battery 15 designates one or more batteries whether multiple batteries are connected in series or parallel. Battery housing 14 is also affixed with on/off switch 84 connected within the circuit between battery 15 and lamp 66 to allow control of the flow of electricity to lamp 66. Battery housing 14 is also affixed with a spring biased attachment clip 86, which enables battery housing 14 to be removably attached to belt 88 of user 20. Battery housing 14 is also sized sufficiently small for placement inside a pocket of user 20 if desired.

Figure 3A:
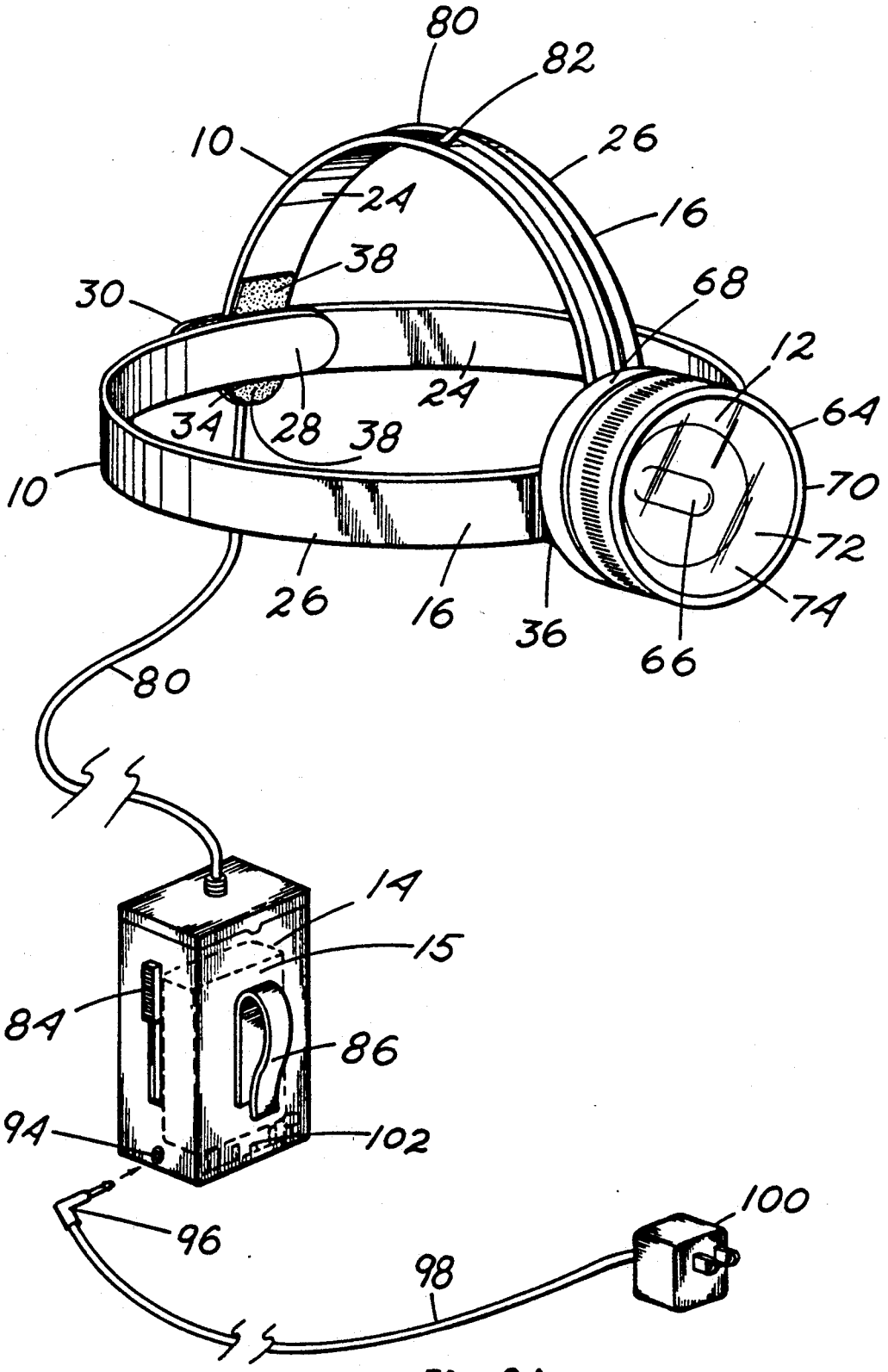
FIG. 3 A is a perspective view of the invention. Also shown is the step-down electrical transformer with cord and plug.
Figure 3B:
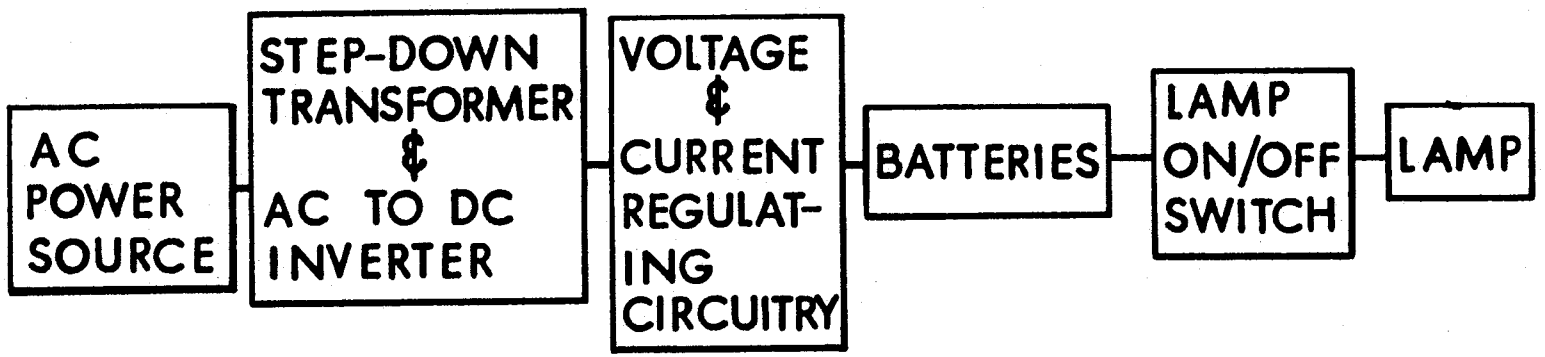

As shown in FIG. 3A, battery housing 14 has an affixed electrical socket or jack 94 positioned in part on the exterior of housing 14 to receive a two conductor electrical plug 96. Plug 96 is connected to one end of a flexible two conductor electrical cord 98, and the opposite end of cord 98 is connected to an electrical step-down transformer 100. Transformer 100 has two extending electrical prongs to allow plugging the transformer into a wall outlet to receive power. The power received by transformer 100 is transformed from the primary voltage of most likely 120 volts AC to low voltage preferably between about 1.5 and 24 volts depending on the battery arrangement used in housing 14. Since batteries operate with direct current, the received alternating current must be rectified or inverted to direct current. The inverting may be accomplished with electronics contained within transformer 100 or within battery housing 14. In order to charge battery 15 without possibly over charging and thereby damaging battery 15, voltage and current regulating circuitry is necessary to sense the battery 15 charge, and regulate the voltage and current flow. In FIG. 3A, circuit board 102 is shown in dotted lines positioned within housing 14 below battery 15. Jack 94 is electrically connected to circuit board 102. In FIG. 3B, an elementary flow chart of the electrical circuitry used with my invention is shown. Circuit board 102 contains the known electronic to regulate voltage and current for the battery 15 charging process, while the primary voltage step-down and inverting is accomplished in transformer 100. Low voltage power from transformer 100 is circuited into circuit board 102 via cord 98, plug 96 and jack 94. From circuit board 102, the regulated power is connected in parallel with battery 15 and lamp 66. With switch 84 in the off position, lamp 66 in taken out of the circuit and battery 15 is brought to a full charge. With switch 84 in the on position, battery 15 and lamp 66 are connected in parallel with circuit board 102 to allow lamp 66 to be continuously powered by power from the load side of circuit board 102. It should be noted those skilled in the art recognize the precise arrangements of the electronics are well know and may be accomplished in a variety of methods and structures.

In utilizing my device, user 20 places headband 10 over the top of head 18, with lamp housing 64 facing forward. To adjust the circumferal fit of headband 10, user 20 disengages second terminal end 30 and distal end 34 of longitudinal band member 22 from engagement with first terminal end 28 of circumferal band member 16. Longitudinal band member 22 is first adjusted across the top of head 18, positioning lamp housing 64 in the desired vertical position, and then distal end 34 is secured with hook and loop fasteners 38 onto first terminal end 28. Second terminal end 30 is then secured to exterior surface 26 of distal end 34, also with hook and loop fasteners 38. Circumferal band member 16 is fitted snugly against head 18 of user 20 but not tight enough to create excess pressure which will eventually become uncomfortable to user 20. Battery housing 14 is then placed in the pocket of user 20 or clamped onto belt 88 with the use of attachment clip 86. Conductors 80 are sufficiently flexible and long to allow connection of battery housing 14 onto the back of user's 20 belt 88. By positioning the extended length of conductor 80 over user's 20 back, conductor 80 is located out of the way and does not interfere with the task user 20 is engaged in. Lamp assembly 12 can be adjusted to direct the light emitted from lamp 66 in the desired direction, by the use of universal linkage 44. Universal linkage 44 not only allows one hundred eighty degree rotation of lamp assembly 12 on second attachment pin 52, but various vertical and horizontal movements are also possible which reduce or increase the distance between lamp assembly 12 and headband 10. To adjust the focus of the light emitted from lamp 66 onto different objects at varying distances, second housing member 70, of lamp housing 6 is rotated and pulled to extend second housing member 70 outward, thus increasing the distance between lamp 66 and lens 72. Lamp 66 is maintained in a stationary position, mounted into lamp socket 76 of first housing member 68, when second housing member 70, along with reflector 74, is rotated and advanced. Second housing member 70, along with lens 72 and reflector 74, are adjusted in position in relation to lamp 66.

An optional feature of my invention includes the addition of colored lens 90. There are certain types of color vision deficiencies which effect those inflicted with the inability to correctly distinguish between certain colors. The most common color vision deficiency involves red/green color confusion. For instance, red objects may appear to be green, or vis versa. By application of a specifically colored lens 90, over lens 72, the colored light produced will alter the appearance of various colored objects, making certain objects somewhat more distinguishable from others of a similar color. This could be very useful to someone who has a certain type of color blindness, who wishes to work with electrical wiring on cars. Colored lens 90 is removably retained onto the surface of lens 72 with the use of lens retainer 92, which is a flexible, resilient, plastic annular ring which is pressure fitted over the distal end of second housing member 70.

Although I have very specifically described the preferred structures of the invention, it should be understood that the specific details are just that, "preferred" structures given for example to those skilled in the art. Many minor changes in the specific structures described may obviously be made without departing from the scope of the invention, and therefore it should be understood that the scope of the invention is not to be limited by the specification and drawings given for example, but is to be determined by the spirit and scope of my appended claims.

What I claim as my invention:

1. A headlamp apparatus for wearing by a human, comprising in combination:

a widely adjustable headband including an elongated flexible circumferential band member and an elongated flexible longitudinal band member;

said circumferential band member having two oppositely disposed terminal ends, one of said terminal ends affixed with an elongated portion of hook fastener, and the other of said terminal ends affixed with an elongated portion of loop fastener, said affixed hook and loop fasteners of said terminal ends placeable to be facing one another so as to be able to be releasibly connected together in an overlapping arrangement;

said longitudinal band member having one end thereof affixed to said circumferential band member generally centrally between said terminal ends of said circumferential band member and in a portion of said circumferential band member intended to be placed adjacent a person's forehead, a distal end of said longitudinal band member affixed with an elongated portion of hook fastener on one side thereof and further being affixed with an elongated portion of loop fastener on an oppositely disposed side from said hook fastener of said longitudinal band member, said hook fastener of said longitudinal band member placeable to be facing said loop fastener of a said terminal end of said circumferential band member simultaneously with said loop fastener of said longitudinal band member facing said hook fastener of the other said terminal end of said circumferential band member;

said elongated portions of said hook and loop fasteners of said terminal ends of said circumferential band member being sufficiently elongated to provide for adjustability of placement against one another so as to allow said circumferal band member to be snugly affixed around a variety of head sizes simultaneously with said distal end of said longitudinal band member being sandwiched and affixed between said terminal ends of said circumferential band member with said loop fastener of said longitudinal band member affixed to said hook fastener of one said terminal end, and said hook fastener of said longitudinal band member affixed to said loop fastener of the other said terminal end of said circumferential band member, said elongated hook and loop fastener portions of said distal end of said longitudinal band member being sufficiently elongated so as to allow for adjustable fastening thereof to and between said terminal ends with said longitudinal band member extending across a person's head simultaneously with said circumferential band member affixed around the person's head;

a lamp assembly affixed generally centrally to said circumferential band member by an adjustably positionable linkage member, said linkage member providing connective structural means between said headband and said lamp assembly to allow both selective vertical and horizontal positioning of said lamp assembly, said lamp assembly including a lamp housing having a lens affixed in a free end of said housing generally oppositely disposed from said linkage member, a reflector retained inside said housing, a lamp socket within said housing, an electric lamp releasably mounted in said lamp socket and positioned at least in part between said reflector and said lens, means providing selective adjustability of spacing between said lens and said lamp for focusing light emitted from said lamp;

a remote battery housing containing at least one battery, electrical conductors extending between said battery housing and said lamp socket to circuit electrical power from said battery to said lamp, an electrical on/off switch in line with at least one of said electrical conductors to provide means for turning said lamp on and off, said battery housing having means for releasable attachment onto an article of clothing;

voltage transforming and cord means connectable to and between a remote A/C power outlet and an electrical jack on said battery housing for recharging said battery with said battery contained within said battery housing, said voltage transforming and cord means further providing means for supplementing electrical power circuited from said battery to said lamp to extend a period of time which said lamp may be operated.

2. An apparatus according to claim 1 wherein both said circumferential band member and said longitudinal band member are made of relatively thin flexible plastic.

3. A headlamp apparatus for wearing by a human, comprising in combination:

a widely adjustable headband including an elongated flexible circumferential band member and an elongated flexible longitudinal band member;

said circumferential band member having two oppositely disposed terminal ends, one of said terminal ends affixed with an elongated portion of hook fastener, and the other of said terminal ends affixed with an elongated portion of loop fastener, said hook and loop fasteners of said terminal ends placeable to be facing one another so as to be able to be releasibly connected together in an overlapping arrangement;

a suction cup affixed to said circumferential band member generally centrally between said terminal ends of said circumferential band member and in a portion of said circumferential band member intended to be placed adjacent a person's forehead with said suction cup placed against a person's forehead;

said longitudinal band member having one end thereof affixed to said circumferential band member generally centrally between said terminal ends of said circumferential band member, a distal end of said longitudinal band member affixed with an elongated portion of hook fastener on one side thereof and further begin affixed with an elongated portion of loop fastener on an oppositely disposed side from said hook fastener of said longitudinal band member, said hook fastener of said longitudinal band member placeable to be facing said loop fastener of a said terminal end of said circumferential band member simultaneously with said loop fastener of said longitudinal band member facing said hook fastener of the other said terminal end of said circumferential band member;

said elongated portions of said hook and loop fasteners of said terminal ends of said circumferential band member being sufficiently elongated to provide for adjustability of placement against one another so as to allow said circumferential band member to be snugly affixed around a variety of head sizes simultaneously with said distal end of said longitudinal band member being sandwiched and affixed to and between said terminal ends of said circumferential band member with said loop fastener of said longitudinal band member affixed to said hook fastener of one said terminal end, and said hook fastener of said longitudinal band member affixed to said loop fastener of the other said terminal end of said circumferential band member, said elongated hook and loop fastener portions of said distal end of said longitudinal band member being sufficiently elongated so as to allow for adjustable fastening to said terminal ends with said longitudinal band member extending across a person's head simultaneously with said circumferential band member affixed around the person's head;

a lamp assembly affixed generally centrally to said circumferential band member by an adjustably positionable linkage member, said linkage member providing connective structural means between said headband and said lamp assembly to allow both selective vertical and horizontal positioning of said lamp assembly, said lamp assembly including a lamp housing having a clear first lens affixed in a free end of said housing generally oppositely disposed from said linkage member, a reflector retained inside said housing, a lamp socket within said housing, an electric lamp releasably mounted in said lamp socket and positioned at least in part between said reflector and said first lens, means providing adjustability of spacing between said first lens and said lamp for selectively focusing light emitted from said lamp;

means for releasibly attaching a colored second lens to said lamp assembly over said first lens to provide for colored light to be emitted from said lamp assembly when operated;

a remote battery housing containing at least one battery, electrical conductors extending between said battery housing and said lamp socket to circuit electrical power from said battery to said lamp, an electrical on/off switch in line with at least one of said electrical conductors to provide means for turning said lamp on and off, said battery housing having means for releasable attachment onto an article of clothing;

voltage transforming and cord means connectable to and between a remote A/C power outlet and an electrical jack on said battery housing for recharging said battery with said battery contained within said battery housing, said voltage transforming and cord means further providing means for supplementing electrical power circuited from said battery to said lamp to extend a period of time which said lamp may be operated.

4. An apparatus according to claim 3 wherein both said circumferential band member and said longitudinal band member are made of relatively thin flexible plastic.

* * * * *